US005584755A

United States Patent [19]

Alfer et al.

[11] Patent Number: 5,584,755

[45] Date of Patent: Dec. 17, 1996

[54] ABRASIVE WHEEL FOR HAND-GUIDED GRINDING MACHINES, IN PARTICULAR ABRASIVE CUTTING-OFF WHEEL

[75] Inventors: Peter Alfer, Wipperfürth; Diethard Sinram, Meinerzhagen; Theodor Schneider, Solingen, all of Germany

[73] Assignee: August Rüggeberg, Marienheide, Germany

[21] Appl. No.: 194,989

[22] Filed: Feb. 14, 1994

[30] Foreign Application Priority Data

Feb. 15, 1993 [DE] Germany ..... 43 04 513.8
Apr. 7, 1993 [DE] Germany ..... 43 11 529.2

[51] Int. Cl.[6] ..... B24B 33/00; B28D 1/04

[52] U.S. Cl. ..... 451/544; 125/15; 451/546

[58] Field of Search ..... 451/540, 541, 451/544, 546; 125/15

[56] References Cited

U.S. PATENT DOCUMENTS

| | | | |
|---|---|---|---|
| 2,134,738 | 11/1938 | Scheel, Jr. | 451/546 |
| 2,726,493 | 12/1955 | Young et al. | 451/546 |
| 3,123,948 | 3/1964 | Kistler et al. . | |
| 3,256,644 | 6/1966 | Kistler et al. | 451/546 |
| 3,262,230 | 7/1966 | Seymour et al. . | |
| 3,262,231 | 7/1966 | Polch | 451/546 |
| 3,487,590 | 1/1970 | Kistler et al. . | |
| 3,640,027 | 2/1972 | Weiss | 451/541 |
| 3,804,687 | 4/1974 | Peterson | 451/546 |
| 3,828,485 | 8/1974 | McClure | 451/546 |
| 3,838,543 | 10/1974 | La Khani | 451/546 |
| 3,867,795 | 2/1975 | Howard | 451/546 |
| 5,014,678 | 5/1991 | Matsuda | 451/541 |
| 5,040,341 | 8/1991 | Okinaga | 451/541 |
| 5,133,783 | 7/1992 | Tanabe et al. | 451/541 |

FOREIGN PATENT DOCUMENTS

| | | |
|---|---|---|
| 528134 | 4/1954 | Belgium . |
| 0083380 | 7/1983 | European Pat. Off. . |
| 661847 | 6/1938 | Germany . |
| 1291648 | 3/1969 | Germany . |
| 7240816 | 11/1972 | Germany . |
| 2719741 | 11/1978 | Germany . |
| 3819199 | 12/1989 | Germany . |

OTHER PUBLICATIONS

Abstract No. 63–169268. Patent Abstracts of Japan. vol. 12, No. 434. Nov. 16, 1988.

*Primary Examiner*—Timothy V. Eley
*Attorney, Agent, or Firm*—Browdy and Neimark

[57] ABSTRACT

An abrasive wheel, in particular an abrasive cutting-off wheel, comprises an annular cylindrical inner support of metal and an abrasive ring surrounding the latter, both being connected with each other. The abrasive ring projects on both sides from the support in the direction of the common axis. The abrasive ring can be ground off completely. The support is re-usable or at least recyclable.

49 Claims, 3 Drawing Sheets

ABRASIVE WHEEL FOR HAND-GUIDED GRINDING MACHINES, IN PARTICULAR ABRASIVE CUTTING-OFF WHEEL

BACKGROUND OF THE INVENTION

1. Field of the Invention

The invention relates to an abrasive wheel for hand-guided grinding machines, in particular an abrasive cutting-off wheel, comprising an abrasive ring with abrasive grit, a synthetic resin bonding of said abrasive grit, at least one reinforcement layer, a central longitudinal axis, and a recess formed concentrically of said central longitudinal axis and defined by a circumferential surface of the abrasive ring.

2. Background Art

Abrasive wheels of the generic type wear out only to a range of fifty to seventy percent of their original diameter. A considerable part of the abrasive wheel is not exploited. This unused part of the abrasive wheel ranges between thirty to fifty percent of the original weight of the abrasive wheel. This remaining rest must be disposed of in special refuse dumps, which poses more and more problems, the number of special refuse dumps decreasing and the costs growing strongly. The reason for the comparatively high remaining rest of unused abrasive wheel resides in that on the grinding spindles or shafts of hand-guided grinding machines, the abrasive wheels are clamped between flanged plates resting against the front faces and extending over a considerable part of the diameter of the abrasive wheel. The clamping of the abrasive wheels is necessary since the reinforcement tissue can take up the tangential forces that occur only when it is clamped over a sufficient radial portion starting from its inner recess. Furtheron, these reinforcement layers are necessary, since such abrasive wheels for hand-guided grinding machines have to take up lateral forces to a considerable extent, and that when used as a roughing wheel as well as an abrasive cutting-off wheel. Moreover, the flanged plates cannot penetrate into the workpiece for cutting-off by grinding. Additionally, that part of the abrasive cutting-off wheel projecting radially from these flanges and corresponding to the thickness of the workpiece cannot be used up either.

SUMMARY OF THE INVENTION

It is the object of the invention to embody an abrasive wheel of the generic kind in which the amount of waste to be disposed of is reduced strongly.

According to the invention this object is solved by an annular-disk-type inner support having an outer circumferential surface arranged in said recess of said abrasive ring and connected with said abrasive ring. Due to the configuration according to the invention the support can either be re-used or at least recycled; moreover, the abrasive ring can virtually be worked out, i.e. used up completely. As for the application as an abrasive saw, if the abrasive ring projects with at least one front face from a front face of the support, this is suitable to use up the abrasive ring completely. The support only has to be cleaned slightly and can then be used again or entered into an existing recycling process for instance as steel scrap. The connection between the support and the abrasive ring can be structured in a particularly simple and reliable way in an embodiment.

The support can consist of metal sheet, zinc die cast or it can be injection-molded.

If the reinforcement layer comprises reinforcing threads extending tangentially in the vicinity of a central opening and radially tangentially towards the outer circumference and which are deflected at the outer circumference, it is possible to provide the abrasive rings with a, referred to the outside diameter, great recess which is in turn the cause for the total wear-out of the abrasive ring being achieved.

The thickness of the support is clearly less than the thickness of the abrasive ring and, at its outer circumference, the support is provided with a substantially annular cylindrical rim, of which the length in the direction of the central longitudinal axis is greater than the thickness of the support and to the outer circumferential surface of which the abrasive ring is secured, whereby it is achieved that the abrasive wheel for use in hand-guided grinding machines is provided with particularly high flectional elasticity so that lateral forces occuring in parallel to the axis can be compensated without the abrasive ring breaking off the rim of the support.

Further features, advantages and details of the invention will become apparent from the ensuing description of examples of embodiments taken in conjunction with the drawing.

BRIEF DESCRIPTION OF THE DRAWING

FIG. 1 is a cross section of an abrasive cutting-off wheel with a support glued in.

DESCRIPTION OF THE PREFERRED EMBODIMENT

Figure 1:
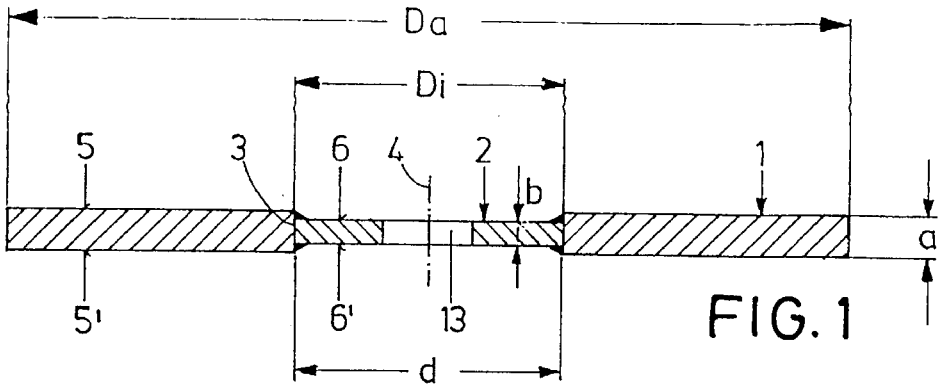

FIG. 1 illustrates an abrasive wheel which is an abrasive cutting-off wheel for a hand-guided grinding machine. It has an annular cylindrical abrasive ring 1 into which a likewise annular cylindrical support 2 is glued. The abrasive ring 1 has a circular recess 3 formed concentrically of the central longitudinal axis 4. The support 2 is inserted into this recess 3. The diameter of the recess 3, i.e. the inside diameter Di of the abrasive ring 1 exceeds the outside diameter d of the support 2 by some tenths of a millimeter. The abrasive ring 1 has an outside diameter Da, $1.4<Da/Di<2$ applying to the relation of Da/Di, i.e. referred to its outside diameter Da, the abrasive ring 1 has a comparatively wide recess 3. 100 mm<Da<300 mm applies to hand-guided cutting-off wheels. 100 mm<Da<230 mm applies to roughing wheels.

The thickness a of the abrasive ring 1 in the direction of the axis 4 is in the range of 2.0 mm to 4.0 mm and is greater than the thickness b of the support 2 in the direction of the axis 4, so that the abrasive ring 1 projects with both its front faces 5, 5' from the front faces 6, 6' of the support 2. Fundamentally, the thickness of the support 2 in the direction of the axis 4 can be equal to the thickness of the abrasive ring 1, the abrasive ring 1 and the support 2 then being arranged plane-parallel one in relation to the other; however, for cutting-off wheels it is of advantage if the thickness b of the support 2 in the direction of the axis 4 is slightly less than the thickness a of the abrasive ring 1 so as to allow or facilitate penetration of the abrasive cutting-off wheel into a workpiece to be cut through. The abrasive ring 1 and the support 2 are connected with each other by means of a suitable glue, preferably an epoxy resin. For the tightest possible adhesion between the abrasive ring 1 and the support 2, the gap 7 resulting from the difference in diameter of D and d between the cylindrical inner circumferential surface 8 of the abrasive ring 1 and the cylindrical outer circumferential surface 9 of the support 2 is filled with a thin annular cylindrical glue layer 10. Further the gussets 11 resulting from the abrasive ring 1 projecting axially from the support 2 are filled with glue seams 12 which engage with the free parts of the cylindrical inner circumferential surface 8 on the one hand and with the adjacent portions of the front faces 6, 6' on the other hand.

Figure 2:
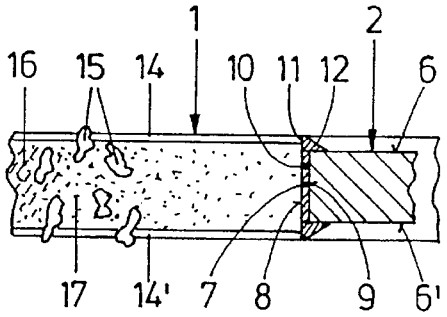
FIG. 2 is a partial section of FIG. 1 on an enlarged scale.

The support 2 has a receiving aperture 13 formed concentrically of the axis 4 for the drive shaft of a hand-guided grinding machine. The support 2 consists of metal, conventionally of steel. It is produced from sheet by punching or turning. As seen in FIG. 2, the abrasive ring 1 has the usual basic structure, i.e. in the vicinity of the front faces 5, 5' it has a reinforcement layer 14, 14' of a configuration still to be described. Abrasive grit 15, preferably from aluminium oxide, silicium carbide, zirkon corundum, sol-gel grain or mixtures thereof, and a bonding agent 16 in the form of pure or modified synthetic resins and fillers 17, such as pyrite and kryolithe, are situated between the reinforcement layers 14, 14'. The abrasive grit 15 has a nominal grain size in the range of 315 to 1000 μm.

Figure 3:
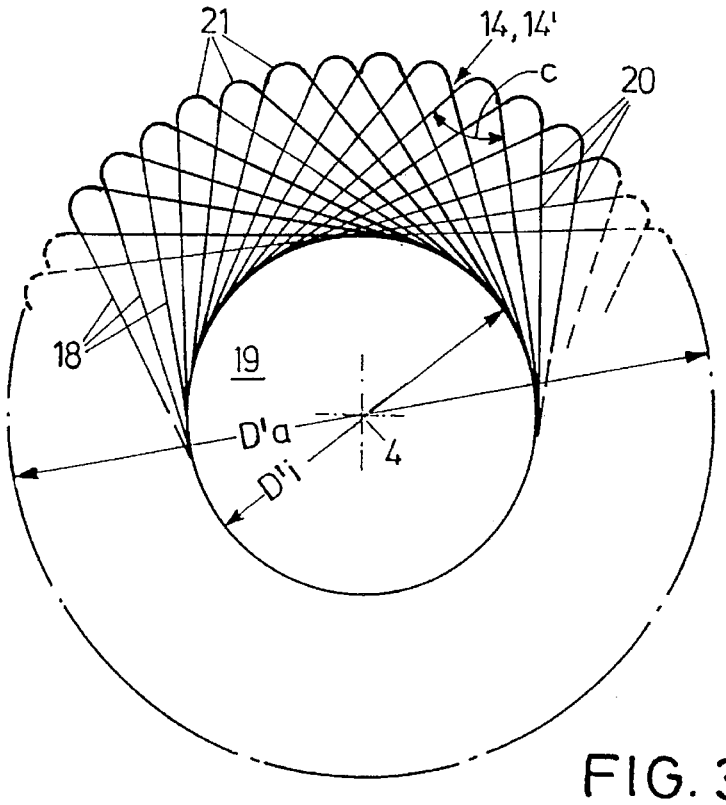
FIG. 3 is a plan view of a triangulated reinforcement layer for the abrasive cutting-off wheel.

FIG. 3 illustrates a reinforcement layer 14 or 14' described in DE 38 19 199 C2 which is to be used preferably in such abrasive rings 1 instead of a tissue, and that in particular with hand-guided abrasive cutting-off wheels. Such a reinforcement layer 14 and 14' is formed from one or several reinforcing threads 18 wich optimally counter any tangential and radial strain on the abrasive ring 1. In the vicinity of a central opening 19 the reinforcing threads 18 extend exactly tangentially; then they extend radially tangentially as far as to the outer circumference where they are deflected and returned in a straight line to the opening 19 past which they are piloted tangentially. Thus, they substantially extend in accordance with the effective strain on the rotating abrasive rings 1. The maximum main strain on a rotating abrasive ring extends in the tangential direction. In the vicinity of the opening 19, i.e. radially within the field of the inner circumferential surface 8 of the abrasive ring 1, the tangential stress, i.e. the tangential force behaviour, has its maximum which continuously decreases outwards. For this reason it is also conceivable for the reinforcing threads 18 only to extend exactly tangentially in the vicinity of the opening 19 while assuming a radial component between the opening 19 and the external rim so as to counter the radial strain likewise strong in this part. The reinforcing threads 18 are connected with each other at the respective intersections 20 by a synthetic resin. The reinforcing threads 18 are soaked in a solution of synthetic resin prior to being placed in the pattern shown in FIG. 3. Once placed the reinforcing threads 18 are hot pressed, whereby this synthetic resin starts to cure so that a connection of the reinforcing threads 18 occurs at the intersections 20. The reinforcement layer 14 and 14' has thus sufficient stability of its own to be used for the production of an abrasive ring 1. The reinforcing threads 18 are straight with the exception of the outer deflections 21 and the inner deflection in the vicinity of the opening 19. The inside diameter Di of the reinforcement layer 14 and 14' substantially corresponds to the inside diameter Di of the abrasive ring 1. An analogous relation applies to the outside diameter D'a of the reinforcement layer 14 and 14' referred to the diameter Da of the abrasive ring 1. The vertex angles c of the reinforcing threads 18 in the vicinity of the deflections 21 depend exclusively on the relation of D'a to D'i, if the radius of curvature in the vicinity of the deflections 21 is neglected. Since the reinforcement layers 18 are substantially arranged as the legs of an isosceles triangle, this is also called a triangulation.

Figure 4:
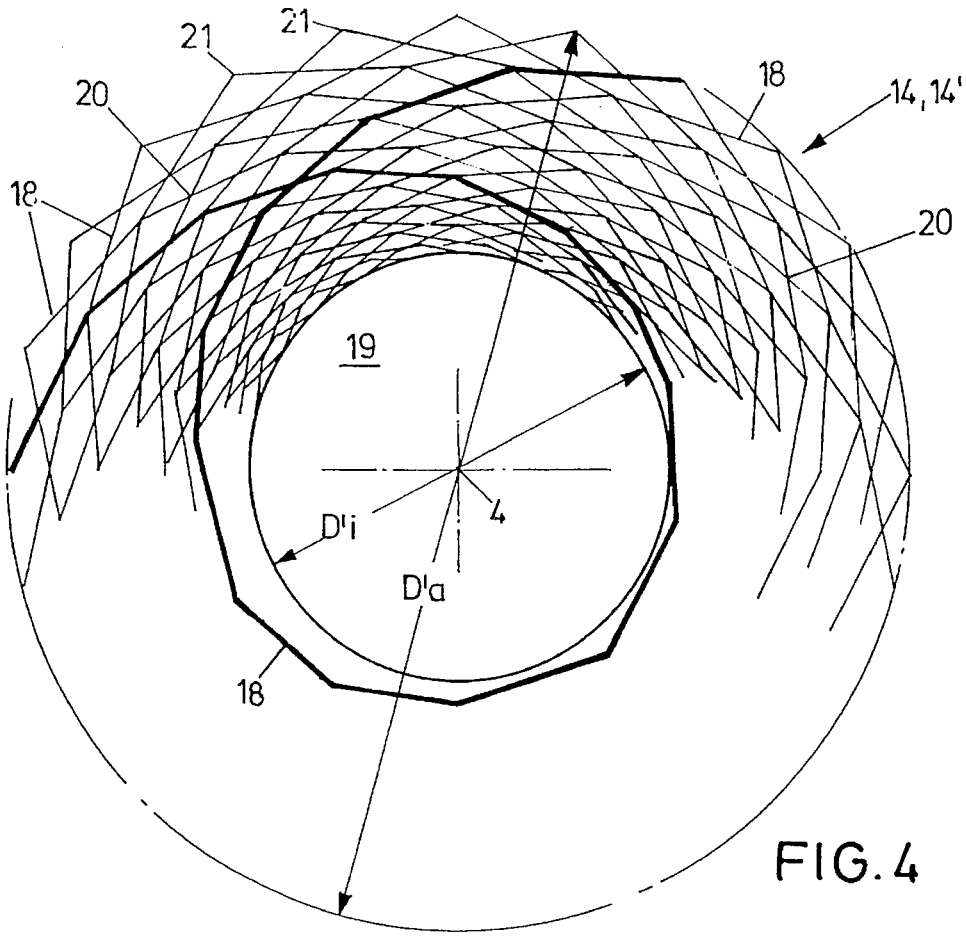
FIG. 4 is a plan view of a spiraled reinforcement layer for the abrasive cutting-off wheel.

FIG. 4 shows a reinforcement layer 14 and 14' with special preference to be used instead of a tissue in the specified abrasive rings 1 of abrasive saws for hand-guided grinding machines. In this embodiment the reinforcing threads 18 are placed starting from the central opening 19 in accordance with the resultant of the direction of main stress. In FIG. 4 the path of such a reinforcing thread is shown in solid lines. It starts—in a mirror symmetrical embodiment—tangentially in the vicinity of the opening 19 and is piloted in what is a bit more than a semi spiral to the outer deflection 21 in such a way that there again it has an almost tangential behaviour. As seen in FIG. 4, a reinforcing thread contacts the central opening 19 approximately punctually. As a consequence, there is no excessive accumulation of material of the reinforcement threads 18 in the vicinity of the opening 19. This fact and the described behaviour of the reinforcing threads make the reinforcement layer 14 and 14' appear even more advantageous than the reinforcement layer according to FIG. 3.

Figure 5:
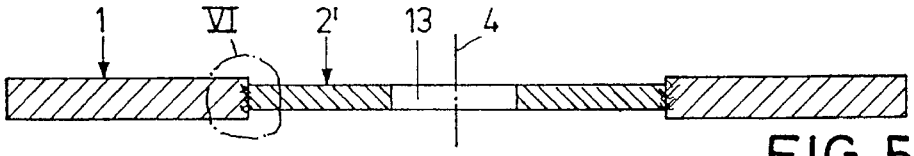
FIG. 5 is a cross section of a further embodiment of an abrasive cutting-off wheel with an integral support.
Figure 6:
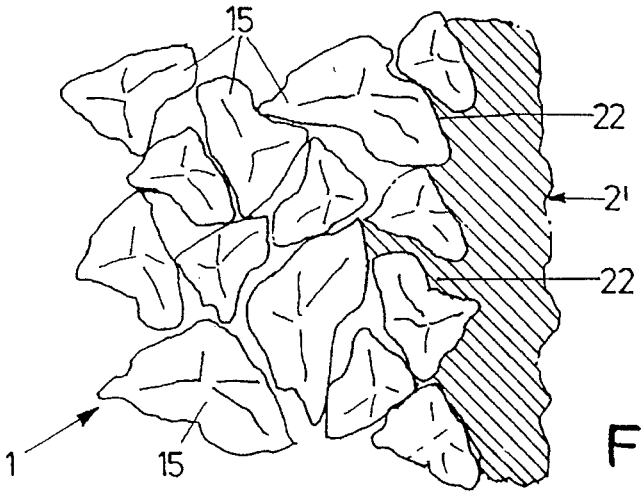
FIG. 6 is a partial section of FIG. 5 on an enlarged scale.

In the embodiment of an abrasive wheel according to FIGS. 5 and 6, the abrasive ring 1 is structured in the same way as in the example of embodiment according to FIGS. 1 and 2. The support 2' is likewise disk-shaped as shown in FIG. 1, the above specifications applying to the thicknesses a and b. It consists of zinc die cast and is manufactured by injection into the recess 3 of the abrasive ring 1. As seen in the enlarged detailed illustration of FIG. 6, the zinc penetrates into cavities 22 between the abrasive grain 15 or the bonding agent 16 and the fillers 17 in the vicinity of the recess 3, whereby a high-strength positive connection between the support 2' and the abrasive ring 1 is produced.

In the following the production of an abrasive wheel is explained by three examples:

Example I

A reinforcement layer 14' is placed into a compression mold. Then grinding granulates consisting of abrasive grit 15, a filler 17 and a bonding agent 16 are added into the mold and a further reinforcement layer 14 is placed thereon. A pressure of 500 to 4000 N/cm$^2$ is then exercised on this package, whereby the abrasive ring 1 is compressed. This compressing is accompanied by adhesion designated as green strength. During this compressing the grinding granulates, i.e. the abrasive grit 15, bonding agents 16 and fillers 17, are forced through the reinforcement layer 14 and 14' outwards.

These compressed, but not yet cured, abrasive rings are stacked between steel plates and put into a furnace for curing, where they are exposed to temperatures of between 120° C. to 200° C. depending on the desired degree of hardness.

A support 2 is glued into these finished cured abrasive rings 1 in the way described. The glue forming the glue layer 10 and the glue seams 12 is then cured in a through-type furnace at about 120° C.

Example II

As far as to the curing process, the production of the abrasive ring 1 is the same as in Example I. Then the support 2 is glued in as described prior to the curing of the abrasive ring 1. The abrasive wheel comprising the abrasive ring I and the support 2 is then stacked between steel plates and put into a furnace for curing as in Example I, the bonding agent 16 of the abrasive ring 1 and the glue of the glue layer 10 and the glue seams 12 now being simultaneously cured at temperatures between 120° C. and 200° C.—depending on the desired degree of hardness.

Example III

The production of the abrasive ring 1 is the same as in Example I. Then this abrasive ring 1 is placed into an injection mold of a zinc injection molding machine and the support 2' is made by injection. Due to the high rate of cooling of the zinc there is no thermally conditioned damage to the abrasive ring 1 and in particular to the bonding agent 16.

It is also known that the abrasive ring 1 may have an inner reinforcement layer instead of outer reinforcement layers 14, 14' located in the vicinity of the grinding faces 5, 5'.

The abrasive wheel can be used until the abrasive ring 1 is completely worn out, and that in particular when used as an abrasive cutting-off wheel, since it can penetrate into a gap procuded on the workpiece by abrasive cutting without collisions occurring between the support 2 and the workpiece treated.

Rests of the abrasive ring 1 and the glue layer 10 and the glue seams 12 can be removed by heating the remaining support 2 and then by brushing with steel brushes. The supports 2 can then be used again. If they are damaged they can be recycled easily.

In the case of the abrasive wheel having a injection-molded support 2' of zinc die cast, rests of the abrasive ring 1 and the support 2' are removed by heating the zinc to the melting temperature.

Figure 7:
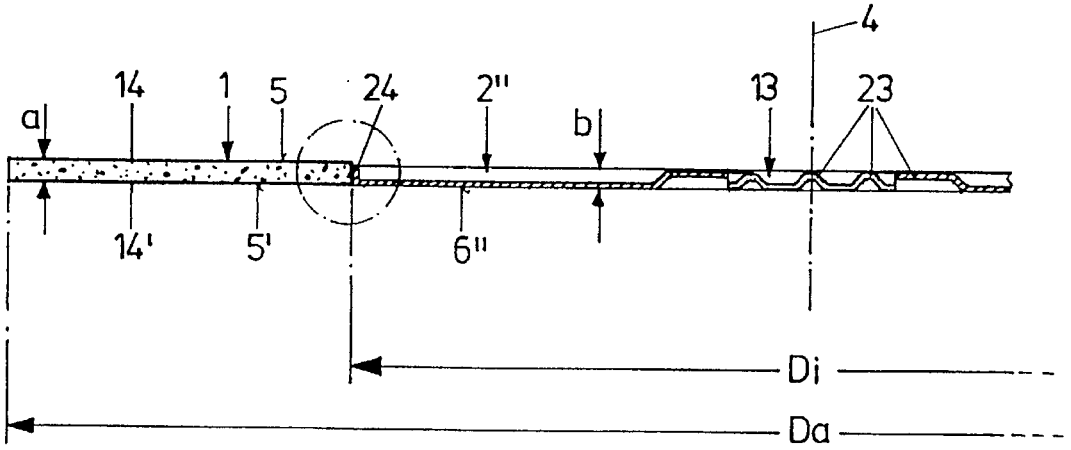
FIG. 7 is a partial cross section through a further embodiment of an abrasive cutting-off wheel.
Figure 8:
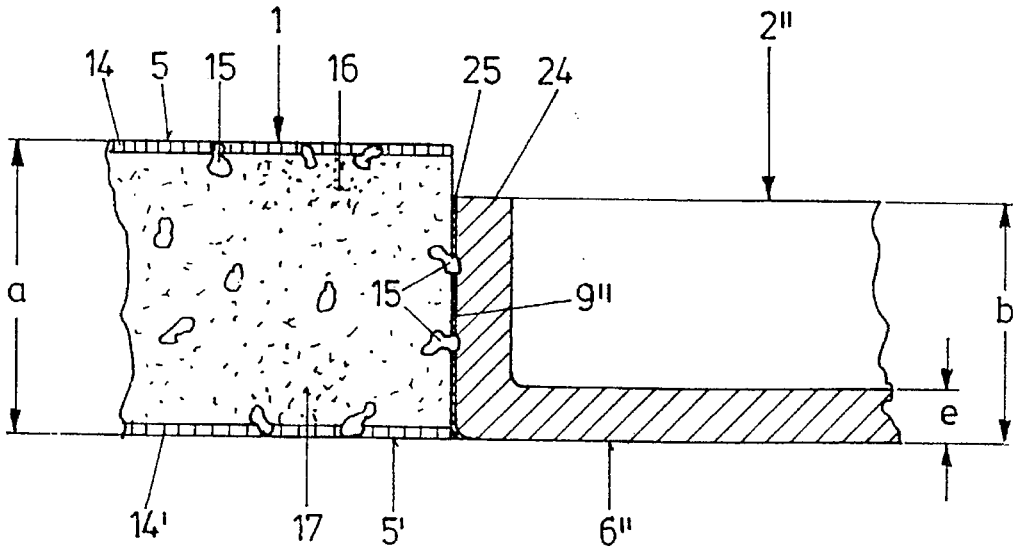
FIG. 8 is a partial section of FIG. 7 on an enlarged scale.

FIGS. 7 and 8 show a hand-guided cutting-off wheel having an abrasive ring 1 on the one hand and a support 2" on the other hand. In structure the abrasive ring substantially corresponds to the structure described above while being provided with reinforcement layers 14, 14' as they are illustrated in FIG. 4 and specified therefor in the above.

The support 2" consists of comparatively thin sheet of steel, if necessary of stainless steel, aluminium or brass, 0.4 mm$\leqq$e$\leqq$1.0 mm applying to its thickness e, and 0,5 mm$\leqq$e$\leqq$0.8 mm applying in practice-oriented cases.

Ribs 23 extending radially to the axis 4 are formed around the receiving aperture 13 for the only purpose of ensuring the support 2" to be fixed on the customary accommodations of the spindles of hand-guided grinding machines.

At its outer rim the very thin support 2" is bent up to form an annular cylindrical rim 24, of which the length b in the direction of the axis 4 is equal to or slightly smaller than the thickness a of the abrasive ring 1. An outer circumferential surface 9" connected with the abrasive ring 1 is formed on the annular cylindrical rim 24. The abrasive ring 1 is arranged directly on the outer circumferential surface 9" of the annular cylindrical rim 24, which will be further explained in the ensuing description of the production. The abrasive cutting-off wheel as shown in FIGS. 7 and 8 is flexible vis-à-vis lateral forces, i.e. forces acting on the abrasive ring 1 at a radial distance from the support 2" in parallel to the axis 4, such that there is no breaking of the abrasive wheel in particular in the vicinity of the rim 24. The support 2" itself is also flexible in parallel to the axis 4. The whole abrasive wheel is flexible as a compound, i.e. irregularities as a result of lateral forces do no occur in the course of the bending stress in the vicinity of the rim 24, so that there is no risk of transverse rupture through lateral forces acting in parallel to the axis 4. On the other hand, the abrasive ring 1, too, is flexible towards such forces, which is due to the synthetic resin bonding of the abrasive ring 1 on the one hand and to the presence of the reinforcement layers 14, 14' on the other hand. For the reasons mentioned above, the thickness 2 of the support 2" must be minor; on the other hand, the rim 24 is necessary for the outer circumferential surface 9" having an axial length b sufficient to transfer the torsional forces to be transferred from the abrasive ring 1 to the support 2" and also the mentioned lateral forces, from the abrasive ring 1 to the support 2". The thickness e of the abrasive ring 1 of abrasive cutting-off wheels is in the range of 2 to 4 mm. Consequently, the thickness 2 of the support 2" is considerably less than the thickness a of the abrasive ring 1. 0.1 a$\leqq$e$\leqq$0.25 a applies. As for the axial length b of the rim 24, it is true that it should be only negligibly smaller than the thickness a. 0.8 a$\leqq$b$\leqq$1.0 a applies in this case.

The relation Da/Di$\leqq$2 applies to this abrasive cutting-off wheel, too; in particular, 1.4$\leqq$Da/Di$\leqq$2 applies. The special spiral arrangement according to FIG. 4 allows the recess 3 of the abrasive ring 1 to be made very large in relation to the outside diameter Da, which in turn results in that the abrasive ring 1 can be used up completely during abrasive cutting, and that to such an extent that there will not remain any rests of the abrasive ring 1 on the rim 24. This is also due to the fact that as far as to the end of the grinding insert in the abrasive ring 1, a reinforcement is available of which the reinforcing threads 18 extend purely tangentially in this portion and can therefore compensate the high tangential forces occurring here in a particularly advantageous way. To avoid any negative impairment of the tight connection between the support 2" and the abrasive ring 1 at the outer circumferential surface 9", the support 2" should have been exposed to some surface treatment working against surface oxidation, in particular against any rust forming on non-stainless steel. Nickel or copper plating the support 2" may be used to the end, but in particular also a plasma polymer treatment of the support 2", such a treatment having an extreme cleaning effect on the one hand and serving to achieve especially high adhesiveness on the other hand, which is particularly advantageous for the outer circumferential surface 9".

In the following the production of the abrasive cutting-off wheel according to FIGS. 7 and 8 is explained by way of example:

Example IV

The outer circumferential surface 9" is provided with a thin layer 25 of an elasticized phenolic formaldehyde glue having the function of an adhesive agent and not being forcibly necessary. Then the support 2" is placed into a compression mold with its face 6" facing away from the rim 24 being placed on the ground of the compression form, i.e. the rim 24 stands up. Then a reinforcement layer 14' is put in of which the opening 19 is completely filled by the support 2". Then the grinding granulates are filled into the compression form and combed in or squeegeed. These grinding granulates consist of the described abrasive grit 15 of a nominal grain size in the range of 600 μm, bonding agent 16 and filler 17, the bonding agent likewise being a phenolic formaldehyde glue which is as a rule identical with what the layer 25 comprises. In any case, it should be a curing polycondensation adhesive. A second reinforcement layer 14 is placed on the combed-in or squeegeed layer of grinding granulates. Then the grinding granulates are pressed together with the support 2" at a pressure of 500 to 4000 N/cm$^2$. During this pressing, abrasive grit 15 is forced into the layer 25 and also in the outer circumferential surface 9" of the rim 24, whereby an especially tight interlocking-type connection is achieved between the abrasive ring 1 and the support 2". These compressed but not yet cured abrasive wheels are stacked between steel plates and put into a furnace for curing and cured at temperatures of between 120° and 200° C. depending on the desired degree of hardness. The production of the connection between the abrasive ring 1 and the support 2" on the one hand and the curing of the grinding granulates on the other hand take place in a single operation.

As for the selection of the bonding agent 16, the abrasive ring 1 itself should have as hard a bonding agent 16 as possible so as to prevent smearing during the grinding operation on the one hand and to ensure early breaking-off of the abrasive grit 15 thus making the abrasive wheel self-sharpening. On the other hand the bonding agent must not be so hard or brittle as to allow the occurance of the abrasive ring 1 breaking off the support 2". Polycondensation adhesives with numerous possibilities of modification have proved to be especially advantageous in this context.

As seen in FIG. 8 and as results from the way of production specified above, the front face 5' of the abrasive ring 1 is in alignment with the front face 6", whereas the front face 5 of the abrasive ring 1 slightly projects from the rim 24 in the direction of the axis 4.

What is claimed is:

1. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9") arranged in said recess (3) of said abrasive ring (1) and connected with said abrasive ring (1);

wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9');

wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19).

2. An abrasive wheel according to claim 1, wherein said abrasive grit (15) is partially forced into said outer circumferential surface (9") of said rim (24).

3. An abrasive wheel according to claim 1, wherein said outer circumferential surface (9") of said rim (24) is provided with a layer (25) of glue of the same kind as said synthetic resin bonding of said abrasive ring (1).

4. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9") arranged in said recess (3) of said abrasive ring (1) and connected with said abrasive ring (1);

wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9');

wherein said abrasive ring (1) has two front faces (5, 5') and wherein said support (2, 2', 2") has two front faces (6, 6') and wherein at least one of said two front faces (5, 5') of said abrasive ring (1) projects from one front face of said two front faces (6, 6') of the support (2, 2', 2").

5. An abrasive wheel according to claim 4, wherein said abrasive ring (1) and said support (2, 2") are glued together.

6. An abrasive wheel according to claim 5, wherein said abrasive ring (1) and said support (2) are glued together by means of an epoxy resin.

7. An abrasive wheel according to claim 4, wherein a gap (7) is formed between said outer circumferential surface (9) of said support (2) and said inner circumferential surface (8) of said abrasive ring (1) and wherein said gap (7) is filled with a glue layer (10) connecting said support (2) with said abrasive ring (1).

8. An abrasive wheel according to claim 4, wherein at least one of said inner circumferential surface (8) of said abrasive ring (1) and of said outer circumferential surface (9, 9") of said support (2, 2") is cylindrical.

9. An abrasive wheel according to claim 4, wherein said support (2, 2") consists of metal sheet.

10. An abrasive wheel according to claim 4, wherein said support (2') is injection-molded in said recess (3) of said abrasive ring.

11. An abrasive wheel according to claim 10, wherein said support (2') consists of die cast zinc.

12. An abrasive wheel according to claim 4, wherein said reinforcing threads (18) extend tangentially and radially tangentially in a straight line.

13. An abrasive wheel according to claim 4, wherein said reinforcing threads (18) partially spiral from said central opening (19) towards said outer circumference.

14. An abrasive wheel according to claim 4, wherein said reinforcement threads (18) cross at intersections (20) and are glued together at said intersections (20).

15. An abrasive wheel according to claim 4, wherein said abrasive grit (15) is partially forced into said outer circumferential surface (9") of said rim (24).

16. An abrasive wheel according to claim 4, wherein said synthetic resin bonding of said abrasive grit (15) is formed by a polycondensation adhesive as a bonding agent (16).

17. An abrasive wheel according to claim 4, wherein said outer circumferential surface (9") of said rim (24) is provided with a layer (25) of glue of the same kind as said synthetic resin bonding of said abrasive ring (1).

18. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9") arranged in said recess (3) of said abrasive ring (1) and connected with said abrasive ring (1);

said recess (3) having an inside diameter Di and said abrasive ring (1) having an outside diameter Da, wherein 1.4<Da/Di<2;

wherein said abrasive ring (1) has two front faces (5, 5') and wherein said support (2, 2', 2") has two front faces (6, 6') and wherein at least one of said two front faces (5, 5') of said abrasive ring (1) projects from one front face of said two front faces (6, 6') of the support (2, 2', 2").

19. An abrasive wheel according to claim 18, wherein said abrasive ring (1) and said support (2, 2") are glued together.

20. An abrasive wheel according to claim 19, wherein said abrasive ring (1) and said support (2) are glued together by means of an epoxy resin.

21. An abrasive wheel according to claim 18, wherein a gap (7) is formed between said outer circumferential surface (9) of said support (2) and said inner circumferential surface (8) of said abrasive ring (1) and wherein said gap (7) is filled with a glue layer (10) connecting said support (2) with said abrasive ring (1).

22. An abrasive wheel according to claim 18, wherein at least one of said inner circumferential surface (8) of said abrasive ring (1) and of said outer circumferential surface (9, 9") of said support (2, 2") is cylindrical.

23. An abrasive wheel according to claim 18, wherein said support (2, 2") consists of metal sheet.

24. An abrasive wheel according to claim 23, wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9').

25. An abrasive wheel according to claim 24, wherein said abrasive grit (15) is partially forced into said outer circumferential surface (9") of said rim (24).

26. An abrasive wheel according to claim 24, wherein said outer circumferential surface (9") of said rim (24) is provided with a layer (25) of glue of the same kind as said synthetic resin bonding of said abrasive ring (1).

27. An abrasive wheel according to claim 18, wherein said support (2') is injection-molded in said recess (3) of said abrasive ring.

28. An abrasive wheel according to claim 27, wherein said support (2') consists of die cast zinc.

29. An abrasive wheel according to claim 18, wherein said synthetic resin bonding of said abrasive grit (15) is formed by a polycondensation adhesive as a bonding agent (16).

30. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9') arranged in said recess (3) of said abrasive ring (1) and connected with said abrasive ring (1), wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19), wherein said reinforcing threads (18) partially spiral from said central opening (19) towards said outer circumference, said recess (3) having an inside diameter Dia and said abrasive ring (1) having an outside diameter Da, wherein 1.4<Da/Di<2.

31. An abrasive wheel according to claim 30, wherein said abrasive ring (1) has two front faces (5, 5') and wherein said support (2, 2', 2") has two front faces (6, 6') and wherein at least one of said two front faces (5, 5') of said abrasive ring (1) projects from one front face of said two front faces (6, 6') of the support (2, 2', 2").

32. An abrasive wheel according to claim 30, wherein said abrasive ring (1) and said support (2, 2") are glued together.

33. An abrasive wheel according to claim 32, wherein said abrasive ring (1) and said support (2) are glued together by means of an epoxy resin.

34. An abrasive wheel according to claim 30, wherein a gap (7) is formed between said outer circumferential surface (9) of said support (2) and said inner circumferential surface (8) of said abrasive ring (1) and wherein said gap (7) is filled with a glue layer (10) connecting said support (2) with said abrasive ring (1).

35. An abrasive wheel according to claim 30, wherein at least one of said inner circumferential surface (8) of said abrasive ring (1) and of said outer circumferential surface (9, 9") of said support (2, 2") is cylindrical.

36. An abrasive wheel according to claim 30, wherein said support (2, 2") consists of metal sheet.

37. An abrasive wheel according to claim 36, wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9').

38. An abrasive wheel according to claim 37, wherein said abrasive grit (15) is partially forced into said outer circumferential surface (9") of said rim (24).

39. An abrasive wheel according to claim 37, wherein said outer circumferential surface (9") of said rim (24) is provided with a layer (25) of glue of the same kind as said synthetic resin bonding of said abrasive ring (1).

40. An abrasive wheel according to claim 30, wherein said support (2') is injection-molded in said recess (3) of said abrasive ring.

41. An abrasive wheel according to claim 40, wherein said support (2') consists of die cast zinc.

42. An abrasive wheel according to claim 30, wherein said reinforcement threads (18) cross at intersections (20) and are glued together at said intersections (20).

43. An abrasive wheel according to claim 30, wherein said synthetic resin bonding of said abrasive grit (15) is formed by a polycondensation adhesive as a bonding agent (16).

44. An abrasive wheel for hand-guided grinding machines, comprising an abrasive ring (1) with abrasive grit (15), a synthetic resin bonding of said abrasive grit (15), at least one reinforcing layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9') arranged in said recess (3) of said abrasive ring (1) and connected with said abrasive ring (1), wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19), wherein a thickness of the abrasive ring in a direction of the axis being in a range of 2.0 mm to 4.0 mm.

45. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9') arranged in said recess (3) of said abrasive ring (1) and connected with said abrasive ring (1), wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19), wherein said reinforcing threads (18) partially spiral from said central opening (19) towards said outer circumference, wherein a thickness of the abrasive ring in a direction of the axis being in a range of 2.0 mm to 4.0 mm.

46. An abrasive wheel for hand-guided grinding machines, comprising an abrasive ring (1) with abrasive grit (15), a synthetic resin bonding of said abrasive grit (15), at least one reinforcing layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9') arranged in said recess (3) of said abrasive ring (1) and connected with said abrasive ring (1), wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19), said recess (3) having an inside diameter Di and said abrasive ring (1) having an outside diameter Da, wherein $1.4<Da/Di<2$, wherein a thickness of the abrasive ring in a direction of the axis being in a range of 2.0 mm to 4.0 mm.

47. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9') arranged in said recess (3) of said abrasive ring (1) and connected with said abrasive ring (1), wherein said reinforcement layer (14, 14') has a central opening (19) and an outer circumference and comprises reinforcing threads (18) extending tangentially in the vicinity of said central opening (19) and radially tangentially towards said outer circumference and are deflected at said outer circumference to return to the vicinity of said central opening (19), wherein said reinforcing threads (18) partially spiral from said central opening (19) towards said outer circumference, said recess (3) having an inside diameter Di and said abrasive ring (1) having an outside diameter Da, wherein $1.4<Da/Di<2$, wherein a thickness of the abrasive ring in a direction of the axis being in a range of 2.0 mm to 4.0 mm.

48. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9") arranged in said recess (3) of said abrasive ring (1) and connected with said abrasive ring (1);

wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9');

wherein said reinforcement layer (14, 14') has a central opening (19) and an outer circumference and comprises reinforcing threads (18) extending tangentially in the vicinity of said central opening (19);

wherein said reinforcing threads (18) extend tangentially and radially tangentially in a straight line.

49. An abrasive wheel for hand-guided grinding machines, comprising an abrasive ring (1) with abrasive grit (15), a synthetic resin bonding of said abrasive grit (15), at least one reinforcement layer (14, 14"), a central longitudinal axis (4), and a recess (3) formed concentrically of said central longitudinal axis (4) and defined by a circumferential surface (8) of the abrasive ring (1), and an annular-disk-type inner support (2, 2', 2") having an outer circumferential surface (9, 9") arranged in said recess (3) of said abrasive ring (1) and connected with said abrasive ring (1);

wherein said support (2") has a thickness (e) and said abrasive ring (1) has a thickness (a) and said thickness (e) of said support (2") is substantially less than said thickness (a) of said abrasive ring (1) and wherein, at its outer circumference, said support (2") is provided with an substantially annular cylindrical rim (24) having a length (b) in the direction of said central longitudinal axis (4), which length is greater than said thickness (e) of said support (2"), and wherein said outer circumferential surface (9") is provided on said rim (24) and wherein said abrasive ring (1) is secured to said outer circumferential surface (9');

wherein said reinforcement layer (14, 14') has a central opening (19) and an outer circumference and comprises reinforcing threads (18) extending tangentially in the vicinity of said central opening (19);

wherein said reinforcing threads (18) spiral from said central opening (19) towards said outer circumference.

* * * * *